US009179506B2

(12) United States Patent
Sim et al.

(10) Patent No.: US 9,179,506 B2
(45) Date of Patent: Nov. 3, 2015

(54) DOOR CHOKE AND COOKING APPARATUS INCLUDING THE SAME

(75) Inventors: Sunghun Sim, Seoul (KR); Jaekyung Yang, Seoul (KR); Hyunwook Moon, Seoul (KR); Heungsik Choi, Seoul (KR); Wansoo Kim, Seoul (KR); Rina Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1194 days.

(21) Appl. No.: 13/115,768

(22) Filed: May 25, 2011

(65) Prior Publication Data

US 2011/0290230 A1 Dec. 1, 2011

(30) Foreign Application Priority Data

May 26, 2010 (KR) ..... 10-2010-0049252
Dec. 23, 2010 (KR) ..... 10-2010-0133737

(51) Int. Cl.
*H05B 6/76* (2006.01)

(52) U.S. Cl.
CPC ..... *H05B 6/763* (2013.01)

(58) Field of Classification Search
CPC ..... H05B 6/763; F24C 15/02; F24C 15/00
USPC ..... 219/736, 738, 739, 741, 742, 743
See application file for complete search history.

(56) References Cited

U.S. PATENT DOCUMENTS 3,584,177 A * 6/1971 Bucksbaum ..... 219/741
3,629,537 A * 12/1971 Haagensen ..... 219/741
4,102,041 A * 7/1978 Copping et al. ..... 29/600
4,347,420 A * 8/1982 Ikeda et al. ..... 219/742
4,523,069 A * 6/1985 Staats ..... 219/742
4,525,614 A * 6/1985 Ishino et al. ..... 219/743
4,645,892 A * 2/1987 Gustafsson ..... 219/742
4,742,201 A * 5/1988 Nakano et al. ..... 219/742
5,206,478 A * 4/1993 Lee ..... 219/742
5,705,797 A * 1/1998 Seo ..... 219/742
2004/0079751 A1* 4/2004 Kim et al. ..... 219/741
2007/0012689 A1* 1/2007 Sim et al. ..... 219/741
2008/0290087 A1 11/2008 Ben-Shmuel et al.
2009/0045191 A1 2/2009 Ben-Shmuel et al.
2009/0057302 A1 3/2009 Ben-Shmuel et al.
2009/0236333 A1 9/2009 Ben-Shmuel et al.
2009/0236334 A1 9/2009 Ben-Shmuel et al.
2009/0236335 A1 9/2009 Ben-Shmuel et al.
2010/0006564 A1 1/2010 Ben-Shmuel et al.
2010/0006565 A1 1/2010 Ben-Shmuel et al.

FOREIGN PATENT DOCUMENTS

WO WO 2007/096878 8/2007
WO WO 2009/104191 8/2009

* cited by examiner

*Primary Examiner* — Dana Ross
*Assistant Examiner* — Joseph Iskra
(74) *Attorney, Agent, or Firm* — Dentons US LLP

(57) ABSTRACT

Provided herein are a door choke and a cooking apparatus including the same. The cooking apparatus includes a front plate forming the front surface of a cavity, a door to open and close the cavity, and a door choke including a first attachment member attached to the door and including at least two bent parts and a second attachment member attached to the door and including at least two bent parts so as to be separated from the first attachment member to form a space, and a bending direction of the first attachment member and a bending direction of the second attachment member are opposite to each other. Thereby, effective electromagnetic interference shielding is achieved.

17 Claims, 19 Drawing Sheets

DOOR CHOKE AND COOKING APPARATUS INCLUDING THE SAME

CROSS-REFERENCE TO RELATED APPLICATION

This application claims the benefit of Korean Patent Application Nos. 10-2010-0049252, filed on May 26, 2010 and 10-2010-0133737, filed on Dec. 23, 2010 in the Korean Intellectual Property Office, the disclosure of which are hereby incorporated by reference in their entirety as if fully set forth herein.

BACKGROUND OF THE INVENTION

1. Field of the Invention

The present invention relates to a door choke and a cooking apparatus including the same, and more particularly to a door choke which achieves effective electromagnetic interference shielding and a cooking apparatus including the same.

2. Description of the Related Art

In general, a cooking apparatus using microwaves, for example, a microwave oven, uses microwaves of a high frequency (approximately 2.45 GHz) generated by a magnetron as a heating source.

When such high-frequency microwaves are irradiated into a space to accommodate food, i.e., a cavity, molecules of the food vibrate and thus the food is heated. Here, the high-frequency microwaves leak through a gap generated between the cavity and a door to open and close the cavity.

In order to remove the microwaves generated by the above-described magnetron, various methods have been attempted.

SUMMARY OF THE INVENTION

An object of the present invention is to provide a cooking apparatus having a door choke which achieves effective electromagnetic interference shielding.

To achieve the above objects, there is provided a cooking apparatus according to an exemplary embodiment of the present invention, including a plate forming a cavity, a door to open and close the cavity, and a door choke attached to the door and including a first attachment member including at least two bent parts and a second attachment member including at least two bent parts so as to be separated from the first attachment member to form a space, a bending direction of the first attachment member and a bending direction of the second attachment member being opposite to each other.

To achieve the above objects, there is provided a cooking apparatus according to an exemplary embodiment of the present invention, including a plate forming a cavity, a door to open and close the cavity, and a door choke attached to the door and including an adjacent part having an oblique structure which is adjacent to the plate when the door is closed.

To achieve the above objects, there is provided a door choke according to an exemplary embodiment of the present invention, including a first attachment member attached to a door and including at least two bent parts, and a second attachment member attached to the door and including at least two bent parts so as to be separated from the first attachment member to form a space, wherein a bending direction of the first attachment member and a bending direction of the second attachment member are opposite to each other.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

The advantages and features of the present invention, and the way of attaining them, will become apparent with reference to embodiments described below in conjunction with the accompanying drawings.

Hereinafter, it will be understood that suffixes "module", "unit", and "part" applied to elements used in the following description are used in consideration of ease of illustration and the suffixes themselves do not have discriminative meanings or roles. Therefore, the suffixes "module", "unit", and "part" may be used interchangeably.

Figure 1:
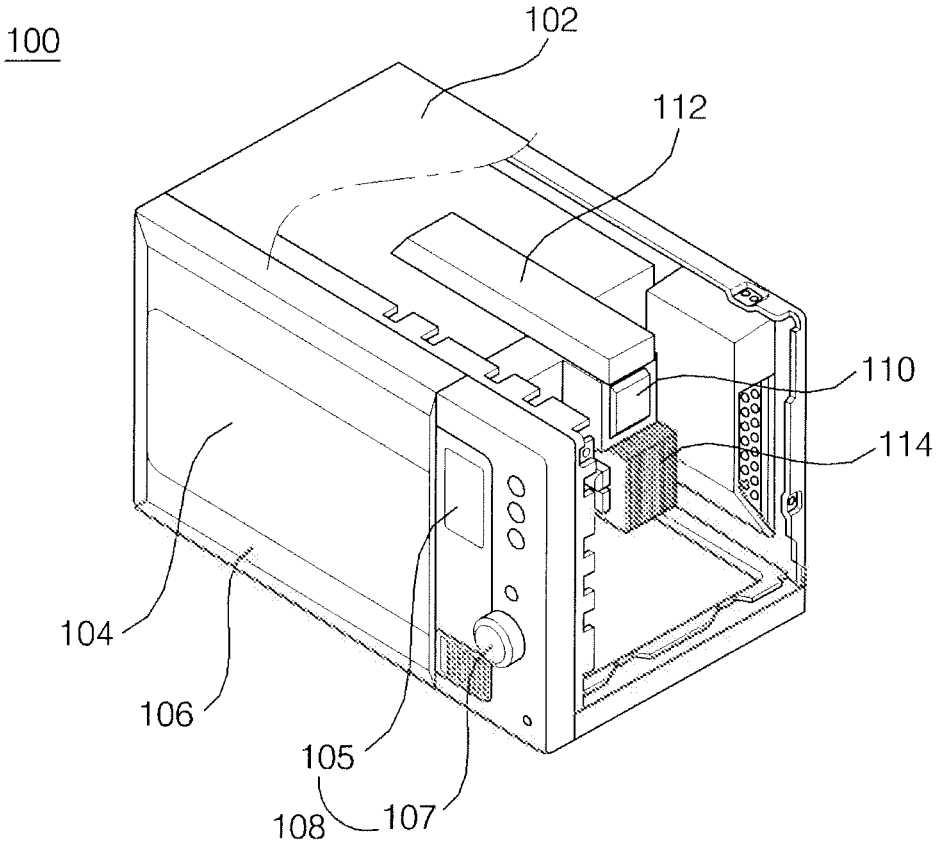
FIG. 1 is a partial perspective view of a cooking apparatus in accordance with one embodiment of the present invention.
Figure 2:
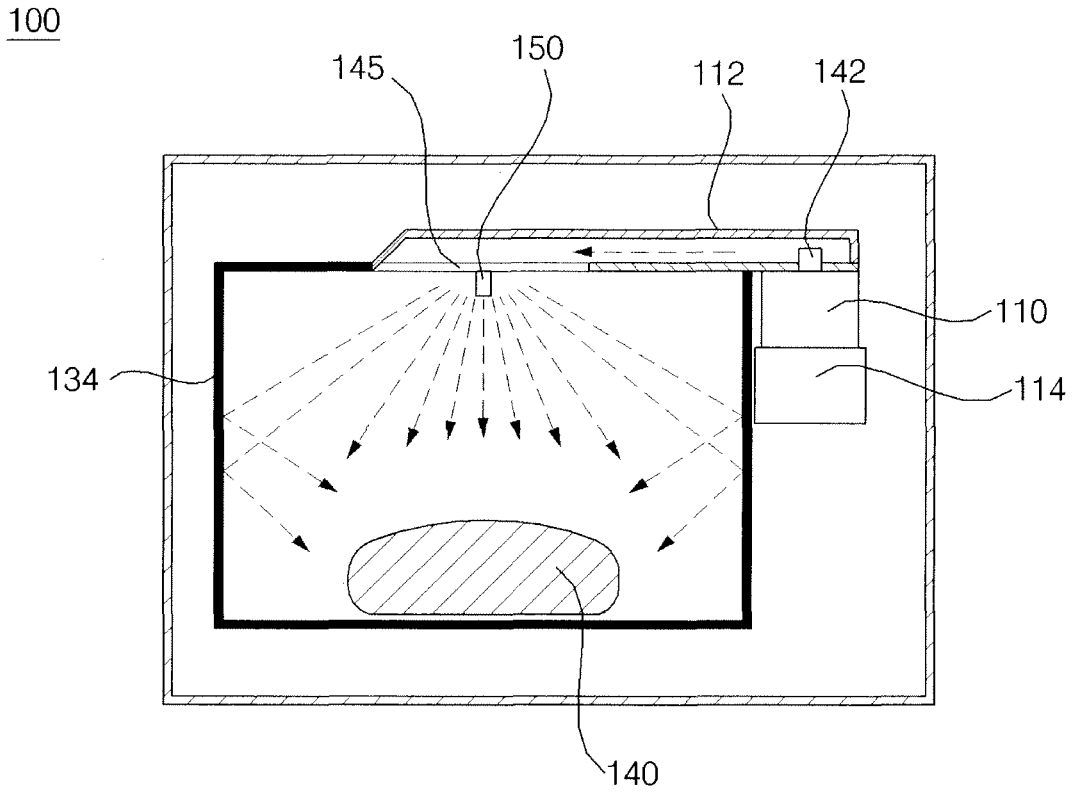
FIG. 2 is a cross-sectional view of the cooking apparatus of FIG. 1.

FIG. 1 is a partial perspective view of a cooking apparatus in accordance with one embodiment of the present invention, and FIG. 2 is a cross-sectional view of the cooking apparatus of FIG. 1.

With reference to FIGS. 1 and 2, a cooking apparatus 100 in accordance with the embodiment of the present invention is configured such that a door 106 provided with a cooking window 104 is connected to a front surface part of a main body 102 so as to be opened and closed and an operation panel 108 is connected to one side of the front surface of the main body 102.

The door 106 opens and closes a cavity 134, and a door choke (not shown) to shield electromagnetic interference may be disposed on the inner surface of the door 106.

The operation panel 108 includes an input unit 107 to control operation of the cooking apparatus 100 and a display 105 to display the operating state of the cooking apparatus 100.

The cavity 134 having an accommodation space of a designated size is provided within the main body 102 such that an object to be heated, for example, food may be accommodated within the cavity 134 and be cooked by microwaves.

The cavity 134 is formed by bonding plates, each of which forms at least one surface, and has an approximately rectangular parallelepiped shape having an opened front surface.

For example, the cavity 134 may be formed by an upper plate forming a ceiling, a rear plate forming the rear surface of the cavity 134, a bottom plate forming the bottom surface of the cavity 134, and a side plate forming the side surfaces of the cavity 134. Further, the door 106 may be disposed on the front surface of the cavity 134. Here, a front plate forming the front surface of the cavity 134 may be formed at regions excluding the door 106.

A microwave generator 110 to generate microwaves is installed on the outer surface of the cavity 134, and a microwave transmission unit 112 to guide the microwaves generated by the microwave generator 112 to the inside of the cavity 134 is disposed at the output side of the microwave generator 110.

The microwave generator 110 may include a magnetron, a Solid State Power Amplifier (SSPA) using a semiconductor, or a Solid State Power Oscillator (SSPO) using a semiconductor.

The SSPA is advantageous in that the SSPA occupies less space than the magnetron. Further, the SSPO is advantageous in that the SSPO does not require a Voltage Controlled Oscillator (VCO) and a Voltage Controlled Attenuator (VCA) as required by the SSPA and thus occupies less space than the SSPA and has a simple circuit configuration.

The SSPA or the SSPO may be implemented as a Hybrid Microwave Integrated Circuit (HMIC) in which passive elements (capacitors, inductors, etc.) and active elements (transistors, etc.) for amplification are separately provided, or a Monolithic Microwave Integrated Circuit (MMIC) in which passive elements and active elements are integrated into one substrate.

The microwave generator 110 may be implemented as one module into which SSPAs or SSPOs are integrated, and may be referred to as a Solid State Power Module (SSPM).

In accordance with the embodiment of the present invention, the microwave generator 110 may generate and output a plurality of microwaves of different frequencies. These frequencies of the microwaves may be in the range of approximately 900 MHz~2,500 MHz. Particularly, the frequencies of the microwaves may be in a designated range around 915 MHz or in a designated range around 2,450 MHz.

The microwave transmission unit 112 transmits a plurality of microwave frequencies generated by the microwave generator 110 to the cavity 134. Such a microwave transmission unit 112 may include a transmission line. The transmission line may be a waveguide, a microstrip line or a coaxial cable. In order to deliver the generated microwaves to the microwave transmission unit 112, a feeder 142 is connected, as shown in FIG. 2.

The microwave transmission unit 112 may include an opening 145 communicating with the inside of the cavity 134, as shown in FIG. 2.

The opening 145 may have various shapes, such as a slot. The microwaves are discharged to the cavity 134 through the opening 145.

Although the drawings illustrate one opening 145 as being disposed at the upper portion of the cavity 134, the opening 145 may be disposed at the lower portion or the side portion of the cavity 134, or a plurality of openings may be disposed.

Further, an antenna may be connected to the end of the microwave transmission unit 112.

A power supply unit 114 to supply power to the microwave generator 110 is provided under the microwave generator 110.

The power supply unit 114 includes a high-voltage transformer to boost power input to the cooking apparatus 100 to high voltage and then to supply the high voltage to the microwave generator 110, or an inverter to supply high output voltage of more than approximately 3,500V, generated through switching operation of at least one switch element, to the microwave generator 110.

A cooking fan (not shown) to cool the microwave generator 110 may be installed around the microwave generator 110.

A resonance mode conversion unit (not shown) to convert a resonance mode in the cavity 134 may be disposed. For example, the resonance mode conversion unit (not shown) may include at least one of a stirrer, a rotating table, a sliding table or a Field Adjustment Element (FAE). Among these, the rotating table and the sliding table may be disposed at the lower portion of the cavity 134, and the stirrer may be disposed at various positions, i.e., lower, side and upper positions, of the cavity 134.

In the above-described cooking apparatus 100, after a user opens the door 106 and puts an object 140 to be heated into the cavity 134, when the user closes the door 106, or closes the door 106 and operates the operation panel 108, particularly the input unit 107, and then presses a start button (not shown), the cooking apparatus 100 is operated.

That is, the power supply unit 114 in the cooking apparatus 100 boosts input AC power to high-voltage DC power and then supplies the high-voltage DC power to the microwave generator 110, the microwave generator 110 generates and outputs corresponding microwaves, and the microwave transmission unit 112 transmits the generated microwaves so as to discharge the microwaves to the inside of the cavity 134. Thereby, the object 140 to be heated, for example, food located within the cavity 134, is heated.

Figure 3:
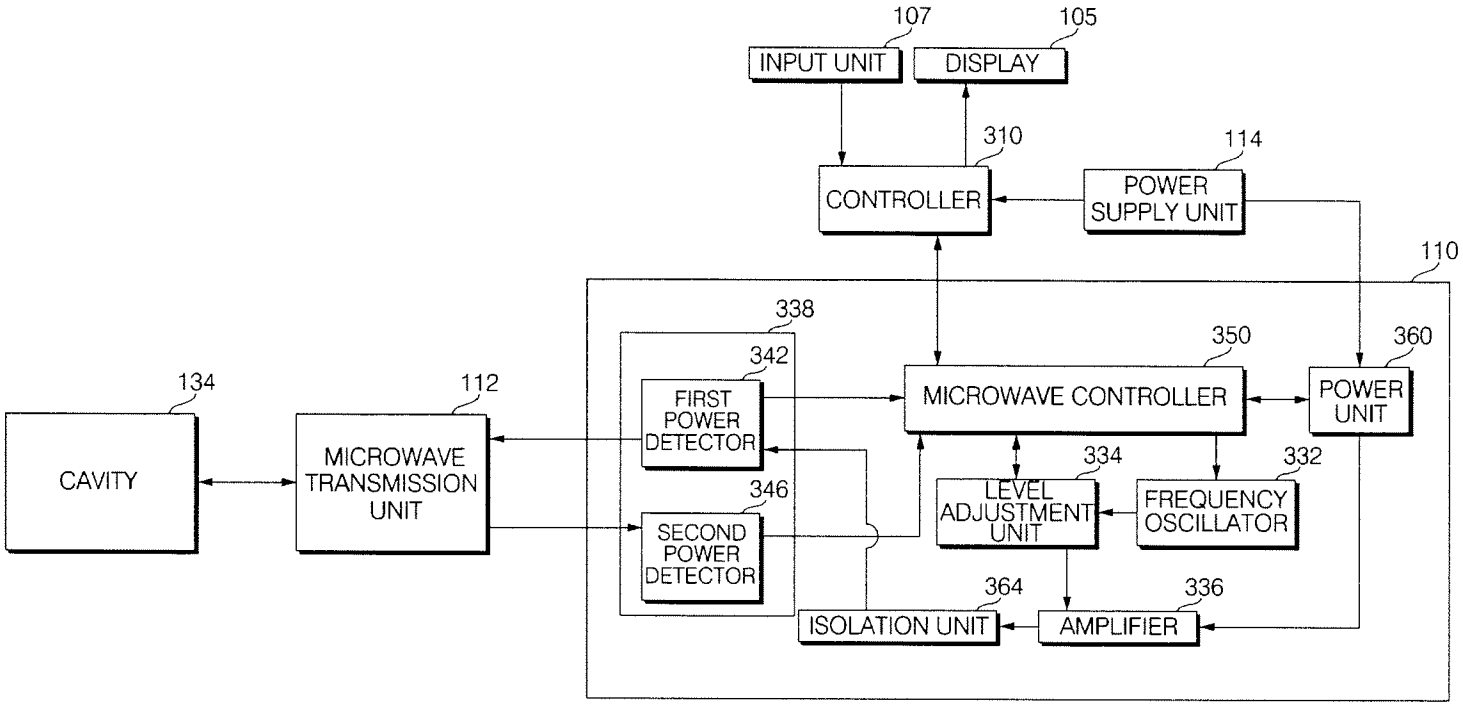
FIG. 3 is a block diagram briefly illustrating one example of the inside of the cooking apparatus of FIG. 1.

FIG. 3 is a block diagram briefly illustrating one example of the inside of the cooking apparatus of FIG. 1.

With reference to FIG. 3, the cooking apparatus 100 in accordance with the embodiment of the present invention includes the microwave generator 110, the microwave transmission unit 112, the cavity 134, a controller 310 and the power supply unit 114.

The microwave generator 110 includes a frequency oscillator 332, a level adjustment unit 334, an amplifier 336, a directional coupler 338, a first power detector 342, a second power detector 346, a microwave controller 350, a power unit 360 and an isolator 364. The microwave generator 110 implemented as the SSPA will be exemplarily described.

In the above elements, two or more elements may be combined into one element, or one element may be divided into two or more elements, as needed in actual applications.

The frequency oscillator 332 oscillates and outputs the microwaves of a corresponding frequency by a frequency control signal from the microwave controller 350. The frequency oscillator 332 may include a Voltage Controlled Oscillator (VCO). The VCO oscillates the corresponding frequency according to a voltage level of the frequency control signal. For example, as the voltage level of the frequency control signal is higher, the frequency oscillated and generated by the VCO is higher.

The level adjustment unit 334 oscillates and outputs the microwaves, having oscillated and output by the frequency signal of the frequency oscillator 332, with corresponding power according to a power control signal. The level adjustment unit 334 may include a Voltage Controlled Attenuator (VCA).

The VCA performs a compensation operation so as to output the microwaves with corresponding power according to the voltage level of the power control signal. For example, as the voltage level of the power control signal is higher, the power level of the signal output from the VCA is higher.

The amplifier 336 amplifies, based on the frequency signal oscillated by the frequency oscillator 332 and the power control signal generated by the level adjustment unit 334, the oscillated frequency signal and then outputs the microwaves.

The Directional Coupler (DC) 338 transmits the microwaves amplified and output from the amplifier 336 to the microwave transmission unit 112. The microwaves output from the microwave transmission unit 112 heat the object in the cavity 134.

Microwaves, which are not absorbed by the object in the cavity 134, instead being reflected by the object, may be input to the DC 338 through the microwave transmission unit 112. The DC 338 transmits the reflected microwaves to the microwave controller 350.

The DC 338 may include the first power detector 342 to detect power of output microwaves and the second power detector 346 to detect power of reflected microwaves. The first power detector 342 and the second power detector 346 may be disposed between the DC 338 and the microwave controller 350, and be disposed on the DC 338 on a circuit.

The first power detector 342 detects output power of microwaves amplified by the amplifier 336 and transmitted to the microwave transmission unit 112 via the DC 338. The detected power signal is input to the microwave controller 350 and is used in heating efficiency calculation. The first power detector 342 may include a resistor, a Schottky diode element, etc. for power detection.

On the other hand, the second power detector 346 detects power of microwaves reflected by the inside of the cavity 134 and received by the DC 338. The detected power signal is input to the microwave controller 350 and is used in heating efficiency calculation. The second power detector 346 may include a resistor, a Schottky diode element, etc. for power detection.

The microwave controller 350 is operated by drive power supplied from the power unit 360 of the microwave generator 110. The microwave controller 350 may control operation of the elements of the microwave generator 110 in communication with the controller 310.

The microwave controller 350 calculates heating efficiencies based on microwaves, which are not absorbed by the object, instead being reflected by the object, from among the microwaves discharged to the inside of the cavity 134.

$$h_e = \frac{P_t - P_r}{P_t} \quad \text{[Equation 1]}$$

Here, $P_t$ represents power of microwaves discharged to the inside of the cavity 134, Pr represents power of microwaves reflected by the inside of the cavity 134, and $h_e$ represents heating efficiency of microwaves.

According to Equation 1 above, as the power of the reflected microwaves is higher, the heating efficiency $h_e$ is smaller.

If microwaves of a plurality of frequencies are discharged to the inside of the cavity 134, the microwave controller 350 calculates heating efficiencies $h_e$ of the microwaves according to frequencies. Such heating efficiency calculation may be performed throughout the entire cooking session according to the embodiment of the present invention.

In order to effectively achieve heating, the entire cooking session may be divided into a scanning session and a heating session. During the scanning session, the microwaves of the plurality of frequencies are sequentially discharged to the inside of the cavity 134, and heating efficiencies are calculated based on reflected microwaves. Further, during the heating session, the microwaves are output for different output times according to frequencies or only microwaves of a designated frequency are output, based on the heating efficiencies calculated during the scanning session. Preferably, power of the microwaves during the heating session is considerably greater than power of the microwaves during the scanning session.

The microwave controller 350 generates and outputs a frequency control signal so as to vary the output times of the microwaves according to the calculated heating efficiencies. The frequency oscillator 332 oscillates a corresponding frequency according to the input frequency control signal.

The microwave controller 350 generates the frequency control signal so that, if the calculated heating efficiency $h_e$ is high, the output time of the corresponding microwaves becomes short. That is, while the microwaves of the plurality of frequencies are sequentially swept, output times of the microwaves of the plurality of frequencies may be varied according to the calculated heating efficiencies. That is, as the heating efficiency $h_e$ is higher, the corresponding output time is preferably shorter. Thereby, the microwaves of may be uniformly absorbed by the object to be heated within the cavity 134 according to frequencies, thus being capable of uniformly heating the object.

On the other hand, the microwave controller 350 may control the microwaves such that the microwaves of the corresponding frequencies are output, only if the calculated heating efficiencies he according to the frequencies are more than a set reference efficiency. That is, the microwaves of frequencies having low heating efficiencies $h_e$ are excluded from an actual heating time, thereby being capable of effectively and uniformly heating the object.

The microwave controller 350, the power unit 360, the frequency oscillator 332, the level adjustment unit 334, the amplifier 336, the DC 338, the first power detector 342 and the second power detector 346 of the above-described microwave generator 110 may be integrated into one module. That is, these elements may be disposed on a single substrate so as to be integrated into one module.

The microwave controller 350 may calculate heating efficiencies of the microwaves according to frequencies, based on microwaves, which are not absorbed by food in the cavity 134, instead being reflected by the food, from among the microwaves discharged to the inside of the cavity 134, and calculates microwaves of frequencies, the calculated heating efficiencies of which are more than the set reference efficiency. Further, the microwave controller 350 calculates microwave frequencies, and calculates heating times of the calculated microwave frequencies. For example, if heating efficiency is more than the set reference efficiency, as the heating efficiency is higher, the heating time of the microwaves of the corresponding frequency is shorter. Thereby, the object may be uniformly heated.

The microwave controller 350 may control the frequency oscillator 332 and the level adjustment unit 334 so as to output microwaves to heat the food in the cavity to the inside of the cavity 134 based on the calculated heating efficiencies. Preferably, power of microwaves output to the cavity 134 during heating is considerably greater than power of microwaves output to the cavity 134 during measurement of the heating efficiencies.

If the heating efficiency, calculated based on the microwave frequencies reflected by the inside of the cavity 134 from among the output microwaves, is below reference heating efficiency during the heating session, the microwave controller 350 may control the microwave generator 110 so as to stop output of the microwaves of the corresponding frequency and to output the microwaves of the next frequency. Thereby, heating may be effectively performed.

Further, the microwave controller 350 may calculate heating efficiencies of the microwaves of the plurality of frequencies, based on the microwave frequencies reflected by the inside of the cavity 134 from among the microwaves output from the amplifier 336, and may set heating times of the microwaves of the respective frequencies during the heating session according to the calculated heating efficiencies.

For example, if, from among the microwaves of the plurality of frequencies, heating efficiency of microwaves of a first frequency is higher than heating efficiency of microwaves of a second frequency, the microwave controller 350 sets heating time of the microwaves of the first frequency to be shorter than heating time of the microwaves of the second frequency.

The microwave controller 350 may output the same power control signal for the microwaves of the respective frequencies to the microwave generator 110 during heating. Further, the level adjustment unit 334 may output a regular power level according to the input power control signal.

The power unit 360 supplies drive power to the elements of the microwave generator 110. The power unit 360 supplies drive power to the microwave controller 350 and the amplifier 336. The power unit 360 receives external power supplied from the power supply unit 114, performs regulation of the external power, and then supplies the regulated power to the inside of the microwave generator 110.

The isolator 364 is disposed between the amplifier 336 and the DC 338, passes microwaves amplified by the amplifier 336 if the amplified microwaves are transmitted to the cavity 134, and shields microwaves reflected by the inside of the cavity 134. The isolator 347 may include an isolator. The microwaves reflected by the inside of the cavity 134 are absorbed by a resistor in the isolator 364 and thus do not enter the amplifier 336. Thereby, entry of the reflected microwaves to the amplifier 336 is prevented.

The microwave transmission unit 112 transmits a plurality of microwave frequencies generated and output from the microwave generator 110 to the cavity 134. Such a microwave transmission unit 112 may include a transmission line. The transmission line may be a waveguide, a microstrip line or a coaxial cable.

In order to deliver the generated microwaves to the microwave transmission unit 112, the feeder 142 is connected, as shown in FIG. 2.

The controller 310 controls the overall operation of the cooking apparatus 100 in response to a signal received from the input unit 107. The controller 310 communicates with the microwave controller 350 of the microwave generator 110, thus controlling operation of the elements of the microwave generator 110. The controller 310 controls the display 105 so as to display current operation, remaining cooking time, a kind of food to be cooked, etc. of the cooking apparatus 100 to the outside.

The power supply unit 114 may include a high-voltage transformer to boost power input to the cooking apparatus 100 to high voltage and then to supply the high voltage to the microwave generator 110, or an inverter to supply high output voltage of more than approximately 3,500V, generated through switching operation of at least one switch element, to the microwave generator 110. Further, the power supply unit 114 supplies drive voltage to the controller 310.

The block diagram of the cooking apparatus 100 shown in FIG. 3 is a block diagram in accordance with the embodiment of the present invention. The respective elements of the block diagrams may be integrated, added, or omitted according to specifications of the actually implemented cooking apparatus 100. That is, two or more elements may be combined into one element, or one element may be divided into two or more elements, as needed. Further, functions performed by respective blocks are provided to describe the embodiment of the present invention, and detailed operations or devices thereof do not limit the scope of the invention.

Figure 4:
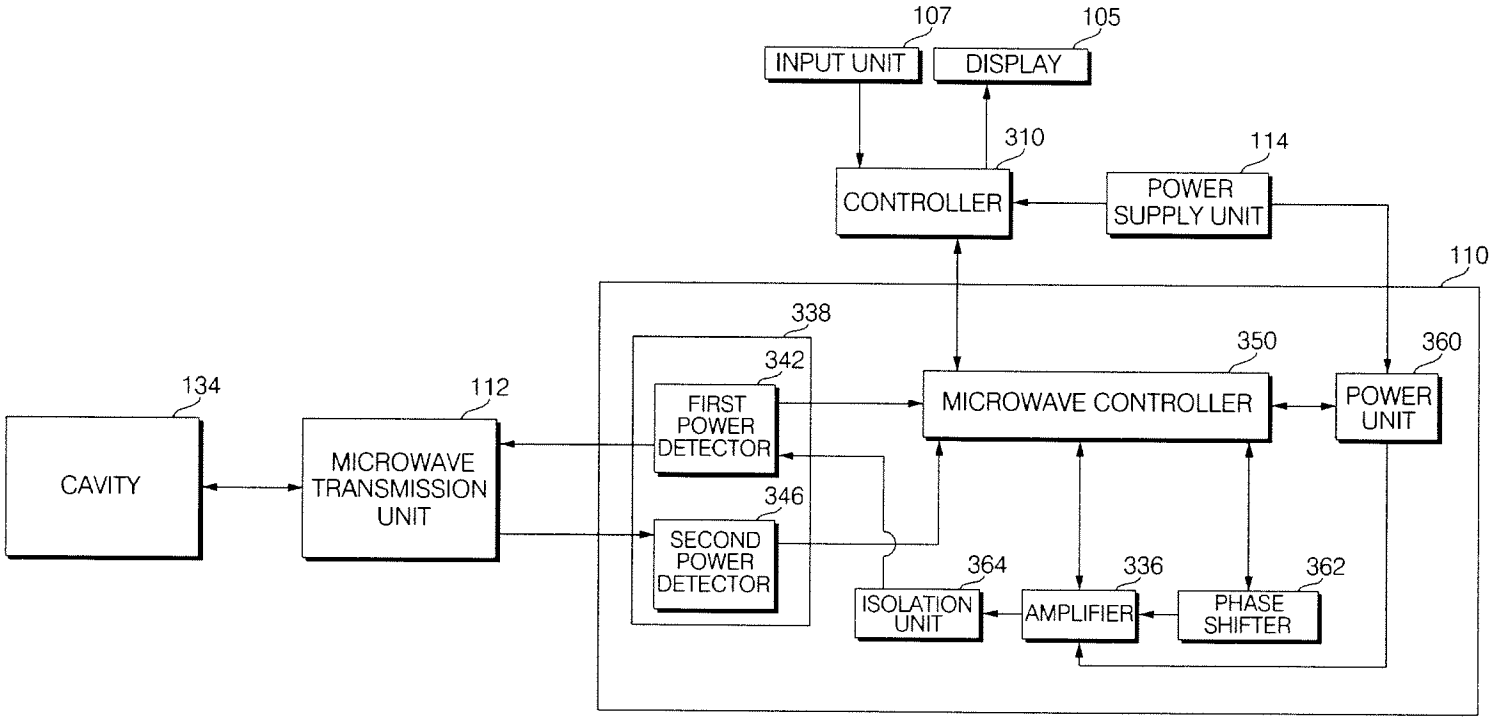
FIG. 4 is a block diagram briefly illustrating another example of the inside of the cooking apparatus of FIG. 1.

FIG. 4 is a block diagram briefly illustrating another example of the inside of the cooking apparatus of FIG. 1.

With reference to FIG. 4, differing from the microwave generator 110 of FIG. 3, the microwave generator 110 implemented as the SSPO will be exemplarily described.

A detailed description of elements of FIG. 4, which are substantially the same as those of FIG. 3, will be omitted.

In accordance with the embodiment of the present invention, the microwave generator 110 may include the microwave controller 350, the power unit 360, a phase shifter 362, the amplifier 336, the isolator 364 and the Directional Coupler (DC) 338.

The DC 338 may include the first power detector 342 and the second power detector 346, as described above.

The microwave generator 110 of FIG. 4 differs from the microwave generator 110 of FIG. 3 in that the microwave generator 110 of FIG. 4 excludes the frequency oscillator 322 and the level adjustment unit 334 of the microwave generator 110 of FIG. 3 and additionally includes the phase shifter 362. Therefore, differing from the microwave generator 110 of FIG. 3, the microwave controller 350 controls the amplifier 336 so as to output microwaves to heat food in the cavity 134, based on calculated heating efficiencies $h_e$, to the inside of the cavity 134.

The amplifier 336 receives DC power supplied from the power supply unit 360, and performs frequency oscillation and amplification for itself. That is, the amplifier 336 performs frequency oscillation and performs amplification operation for itself based on received DC power without a separate frequency oscillator to generate and output a frequency oscillation signal.

The amplifier 336 may include at least one RF power transistor. If a plurality of RF power transistors is used, the plural RF power transistors may be connected in series, in parallel, or through combination of series connection and parallel connection so as to achieve multi-stage amplification. For example, such an amplifier 336 may be an RF power transistor. Further, output of the amplifier 336 may be approximately 100 to 1,000W.

The phase shifter 362 feeds back output of the amplifier 336, thus achieving phase shift. A phase shift amount may be adjusted by a phase control signal of the microwave controller 350. The phase shifter 362 achieves phase shift of an amplification signal of a designated frequency output from the amplifier 336, thereby generating microwaves of various frequencies, as described above. For example, the number of frequencies may be increased in proportion to the phase shift amount.

Preferably, a signal corresponding to approximately 1% to 2% of an amplification signal level of a designated frequency may be sampled and input to the phase shifter 362. This is done in consideration of re-amplification in the amplifier 336 after feedback.

Next, the isolator 364 re-supplies the signal, the phase of which has been shifted by the phase shifter 362, to the amplifier 336. If the level of the signal, the phase of which has been shifted by the phase shifter 362, is below a set value, the isolator 364 may supply the signal, the phase of which has been shifted, to a ground terminal instead of to the amplifier 336.

The signal supplied by the isolator 364 is re-amplified by the amplifier 336. Thereby, microwaves of a plurality of different frequencies are sequentially output.

As described above, since the amplifier 336 performs frequency oscillation and amplification for itself, the microwave generator 110 may be formed in a simple structure. Further, microwaves of a plurality of frequencies may be generated and output using the phase shifter 362.

Figure 5:
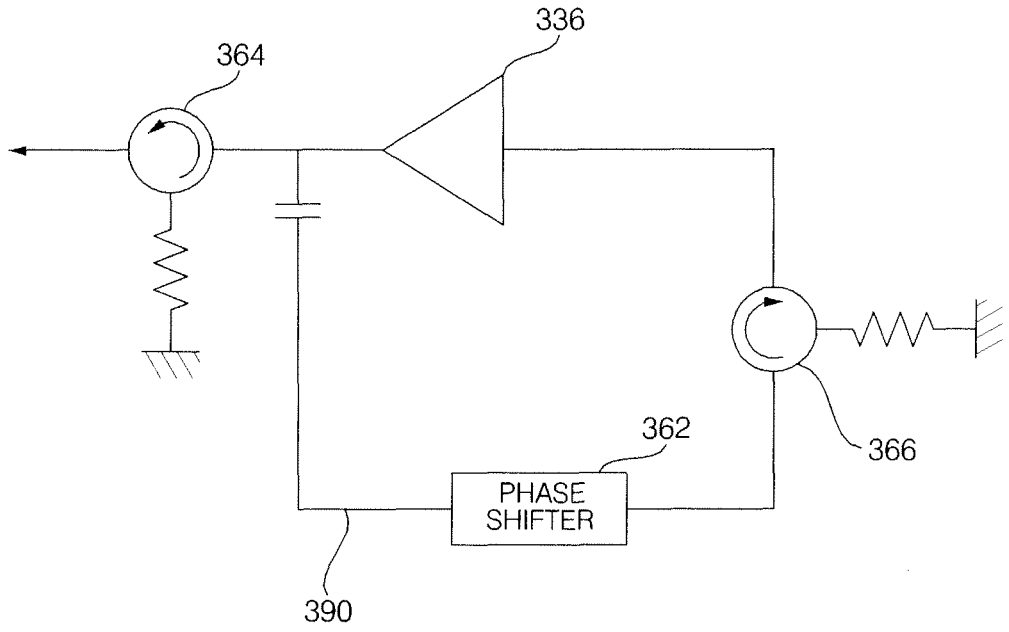
FIG. 5 is a circuit diagram briefly illustrating the inside of a solid state power oscillator of FIG. 4.

FIG. 5 is a circuit diagram briefly illustrating the inside of the SSPO of FIG. 4.

With reference to FIG. 5, the SSPO may include the amplifier 336, the phase shifter 362, the first isolator 364 and a second isolator 366.

The amplifier 336 receives DC power from the power unit 360, and performs frequency oscillation and amplification for itself. That is, the amplifier 336 performs frequency oscillation and performs amplification operation for itself according to receipt of DC power without a separate frequency oscillator to generate and output a frequency oscillation signal.

The amplifier 336 may include at least one RF power transistor. If a plurality of RF power transistors is used, the plural RF power transistors may be connected in series, in parallel, or through combination of series connection and parallel connection so as to achieve multi-stage amplification. For example, such an amplifier 336 may be an RF power transistor. Further, output of the amplifier 336 may be approximately 100 to 1,000W.

Next, the phase shifter 362 may feedback output of the amplifier 336, thus achieving phase shift. A phase shift amount may be adjusted by a phase control signal of the microwave controller 350. The phase shifter 362 may achieve phase shift of an amplification signal of a designated frequency output from the amplifier 336, thereby generating microwaves of various frequencies, as described above. For example, the number of frequencies may be increased in proportion to the phase shift amount.

Preferably, a signal corresponding to approximately 1% to 2% of an amplification signal level of a designated frequency is sampled and input to the phase shifter 362. This is done in consideration of re-amplification in the amplifier 336 after feedback. The first isolator 364 is located between the amplifier 336 and the DC 338, and transmits the microwaves of the plurality of different frequencies, sequentially output from the amplifier 336, to the microwave transmission unit 112. In more detail, the first isolator 364 supplies the microwaves to the microwave transmission unit 112 via the DC 338. If a signal level of the microwaves supplied from the amplifier 336 is below a set value, the first isolator 364 may supply the microwaves to a ground terminal instead of to the microwave transmission unit 112.

Next, the second isolator 366 re-supplies the signal, the phase of which has been shifted by the phase shifter 362, to the amplifier 336. If the level of the signal, the phase of which has been shifted by the phase shifter 362, is below a set value, the second isolator 366 may supply the signal, the phase of which has been shifted, to a ground terminal instead of to the amplifier 336.

The signal supplied by the second isolator 336 is re-amplified by the amplifier 336. Thereby, microwaves of a plurality of different frequencies are sequentially output.

A feedback transmission line 390 serves to connect the output terminal of the amplifier 336 to the phase shifter 362. The phase shifter 362 is located on the feedback transmission line 390, and, in accordance with the embodiment of the present invention, may include impedance elements, such as a switch and/or a diode.

Further, the isolator 364 supplies the microwaves of the plurality of the different frequencies, sequentially output from the amplifier 336, to the microwave transmission unit 112. In more detail, the isolator 364 supplies the microwaves to the microwave transmission unit 112 via the DC 338. If the level of the signal supplied from the amplifier 336 is below a set value, the isolator 364 may supply the microwaves to a ground terminal instead of to the microwave transmission unit 112.

Figure 6:
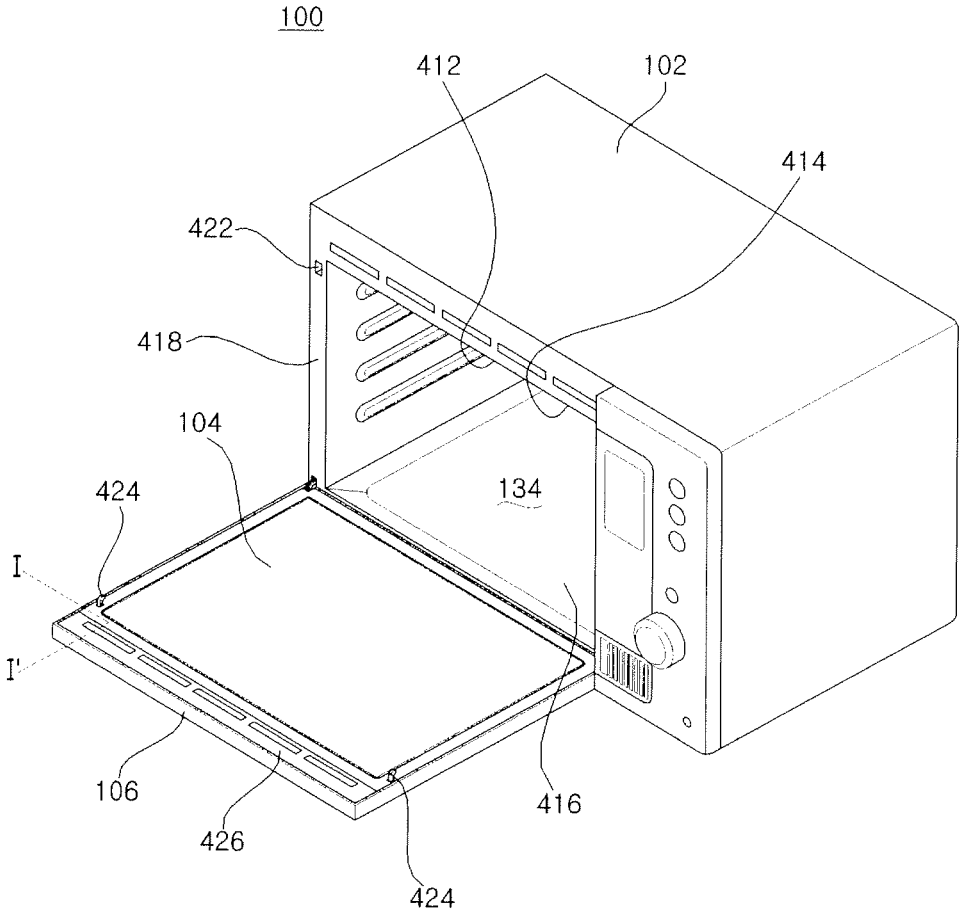
FIG. 6 is a view illustrating one example of opening of a door of the cooking apparatus of FIG. 1.
Figure 7:
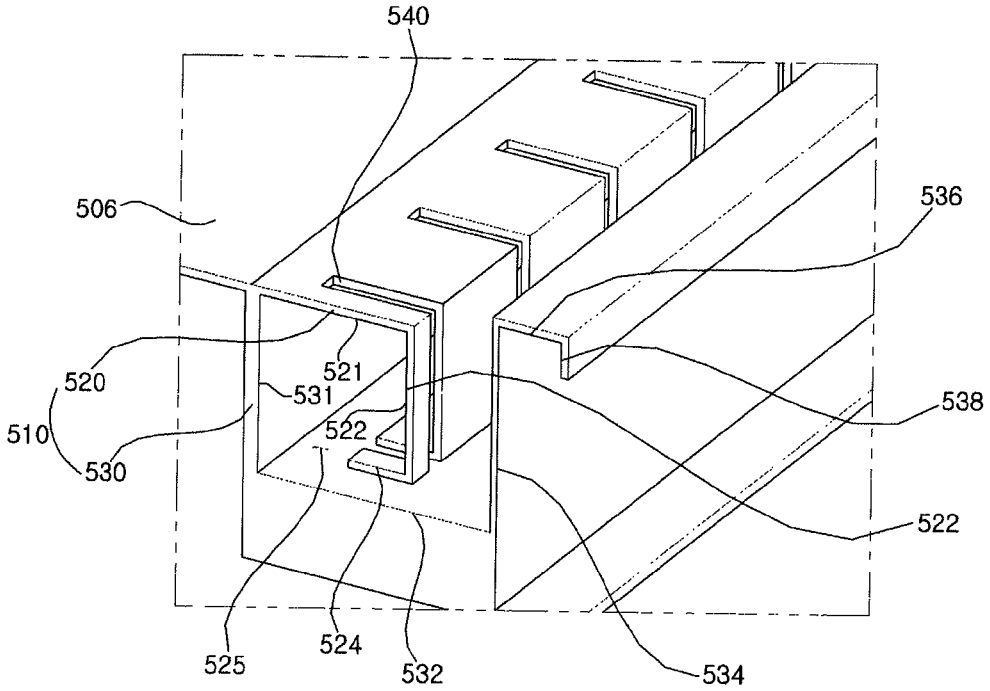
FIG. 7 is a partial perspective view of the door taken along the line I-I' of FIG. 6.

FIG. 6 is a view illustrating one example of opening of the door of the cooking apparatus of FIG. 1, and FIG. 7 is a partial perspective view of the door taken along the line I-I' of FIG. 6.

With reference to FIGS. 6 and 7, the cavity 134 forming a cooking chamber is provided within the main body 102. The cavity 134 is formed by bonding plates, each of which forms at least one surface, and has an approximately rectangular parallelepiped shape having an opened front surface.

Here, the cavity 134 may include an upper plate 412 forming a ceiling, a rear plate 414 forming the rear surface of the cavity 134, a bottom plate 416 forming the bottom surface of the cavity 134, and a front plate 418 forming the front surface of the cavity 134.

The front plate 418 is connected to the front end part of the main body 102. Further, a plurality of outlets is formed on the upper portion of the front plate 418, as shown in FIGS. 6 and 7.

Latch holes 422 may be provided on the front plate 418 at both sides of the cavity 134.

Further, latch hooks 424 to prevent random opening of the door 106 may be provided at both sides of the door 106. The latch hooks 424 are inserted into the latch holes 422 formed on the front plate 418, thereby preventing random opening of the door 106.

A choke cover 426 to cover a door choke 510 attached to the door 106 may be provided on the rear surface of the door 106. Such a choke cover 426 may be formed in a shape surrounding a glass substrate of the cooking window 104. Further, a plurality of inlets is formed at the upper portion of the choke cover 426, as shown in FIGS. 6 and 7.

In order to prevent leakage of microwaves through the cooking window 104, a metal mesh may be attached to the cooking window 104.

The door choke 510 may include a first attachment member 520 attached to the door 106 and including at least two bent parts, and a second attachment member 530 attached to the door 106, including at least two bent parts so as to be separated from the first attachment member 520 to form a space 525.

Although FIG. 7 illustrates the first attachment member 520 as including a base part 521, a first bent part 522 and second bent part 524, and the second attachment member 530 as including a base part 531, a first bent part 532, a second bent part 534, a third bent part 536 and the fourth bent part 538, the first attachment member 520 and the second attachment member 530 are not limited thereto. That is, each of the respective attachment members 520 and 530 may include at least two bent parts.

In the embodiment of the present invention, in order to improve performance of the door choke 510, the two attachment members 520 and 530 are attached to the door 106 and each of the two attachment members 520 and 530 includes at least two bent parts.

In general, a shield frequency to shield electromagnetic interference is calculated based on Equation 2 below.

$$f = \frac{1}{2\pi\sqrt{LC}} \quad \text{[Equation 2]}$$

Here, f represents a shield frequency, L represents an inductance component, and C represents a capacitance component.

As described above, frequencies of microwaves may be in the range of approximately 900 MHz~2,500 MHz. Particularly, since, if a frequency within a designated range around 915 MHz is used, the frequency is lower than a frequency within a designated range around 2,450 MHz, the door choke is preferably designed such that the inductance component L and the capacitance component C of the door choke increase based on Equation 2 above.

With reference to FIG. 7, the inductance component L of the door choke 510 is determined by the number or the length of the bent parts of the first attachment member 520 and the number or the length of the bent parts of the second attachment member 530. That is, as the number of the bent parts increases and the length of the bent parts increases, the entire inductance component L increases.

Slits 540 may be formed on the first attachment member 520 in the bending direction thereof. As the number of the slits 540 increases, i.e. the interval between the slits 540 decreases, the entire inductance component L increases.

Further, the capacitance component C is calculated based on Equation 3 below.

$$C = \mu\frac{A}{d} \quad \text{[Equation 3]}$$

Here, μ represents a dielectric constant of a dielectric, A represents area, and d represents distance. That is, as the an opposite area A between the first attachment member 520 and the second attachment member 530 increases, the distance between the first attachment member 520 and the second attachment member 530 decreases, and the dielectric constant μ increases, the capacitance component C of the door choke 510 increases.

As described above, in order to shield the corresponding frequency f, the numbers or the lengths of the bent parts of the attachment members 520 and 530 of the door choke 510 and the interval between the slits 540, the distance between the first attachment member 520 and the second attachment member 530, or the dielectric constant is preferably adjusted.

Further, the door choke 510 in accordance with the embodiment of the present invention is characterized in that the bending directions of the first attachment member 520 and the second attachment member 530 are opposite to each other, as shown in FIG. 7. Thereby, the door choke 510 may be designed such that the inductance component L and the capacitance component C increase while forming the space 525 in which electromagnetic interference cancellation of microwaves occurs.

Preferably, the door choke 510 is made of a metal to shield electromagnetic interference.

FIGS. 8 to 12 are plan views illustrating various door chokes, as shown in FIG. 7, in accordance with embodiments of the present invention.

Figure 8:
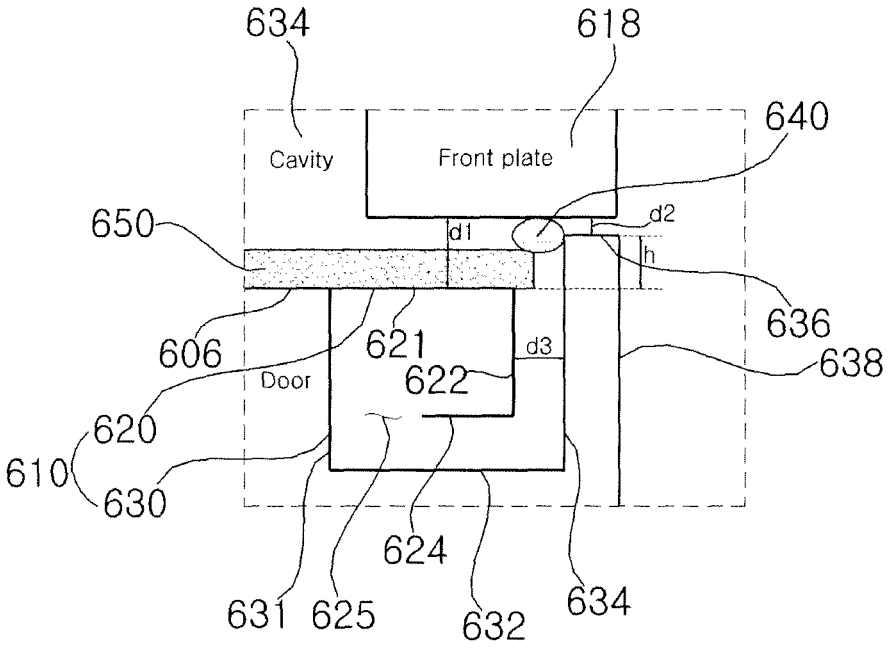
FIGS. 8 to 12 are plan views illustrating various door chokes, as shown in FIG. 7, in accordance with embodiments of the present invention.

First, a door choke 610 of FIG. 8 is attached to a door 606 to open and close a cavity 634. For this purpose, the door choke 610 includes a first attachment member 620 and a second attachment member 630.

The first attachment member 620 includes a base part 621 attached to the door 606 and extended, a first bent part 622 attached to the base part 621 and bent, and a second bent part 624 attached to the first bent part 622 and bent so as to surround a space 625.

The second attachment member 630 includes a base part 631 attached to the door 606 and extended in a direction crossing the door 606, a first bent part 632 attached to the base part 631 and bent so as to surround the space 625, a second bent part 634 attached to the first bent part 632 and bent so as to surround the space 625, a third bent part 636 attached to the second bent part 634 and bent so as to be parallel with a front plate 618, and a fourth bent part 638 attached to the third bent part 636 so as to be parallel with the second bent part 634.

A dielectric 640 is disposed between the first attachment member 620 and the second attachment member 630 so as to increase the capacitance component of the door choke 610, as stated in Equation 3 above. Further, the dielectric 640 serves to prevent foreign substances from the cavity 634 from being introduced into a gap between the first attachment member 620 and the second attachment member 630.

The dielectric constant of such a dielectric 640 is preferably 2 to 10. For example, the dielectric 640 may be formed of various materials having excellent adhesiveness, such as silicon rubber.

Preferably, the dielectric 640 is disposed to be closer to the front plate 618 than the door choke 610, when the door 606 is closed. By protruding the dielectric 640 more than the door choke 610, scratches generated due to collision between the door choke 610 and the front plate 618 when the door 606 is closed may be prevented.

A glass substrate 650 may be disposed as a cooking window on the inner surface of the door 606. Therethrough, a user can easily view the inside of the cavity 634.

The glass substrate 650 is preferably extended to a region between the first attachment member 620 and the second attachment member 630, as shown in FIG. 8. Thereby, foreign substances from the cavity 634 are not introduced into the gap between the first attachment member 620 and the second attachment member 630.

Further, a distance d2 between the second attachment 630 and the front plate 618 is preferably shorter than a distance d1 between the first attachment member 620 and the front plate 618. That is, the end of the second bent part 634 of the second attachment 630 is preferably protruded inwardly from the inner surface of the door 606, so as to have a designated height h.

Thereby, leakage of microwaves within the cavity 634 to the outside along a gap between the second attachment member 630 and the front plate 618 is prevented. Further, the microwaves flow to the inside of the space 625, and are shielded due to interference cancellation. Moreover, when the door 606 is closed, the second attachment member 630 and the front plate 618 are closely adhered to each other.

According to the structure of the door choke 610 of FIG. 8, each of the first attachment member 620 and the second attachment member 630 has at least two bent parts under the condition that the space 625 is formed between the first attachment member 620 and the second attachment member 630, and the first attachment member 620 and the second attachment member 630 are bent in opposite directions, thereby improving the inductance component and the capacitance component.

Therefore, a distance d3 between the first attachment member 620 and the second attachment member 630, specifically, a distance d3 between the first bent part 622 of the first attachment member 620 and the second bent part 634 of the second attachment member 630 may be shortened. Thereby, the door choke 610 may have a small-sized structure. That is, the door choke 610 attached to the door 606 may have a compact structure.

Figure 9:
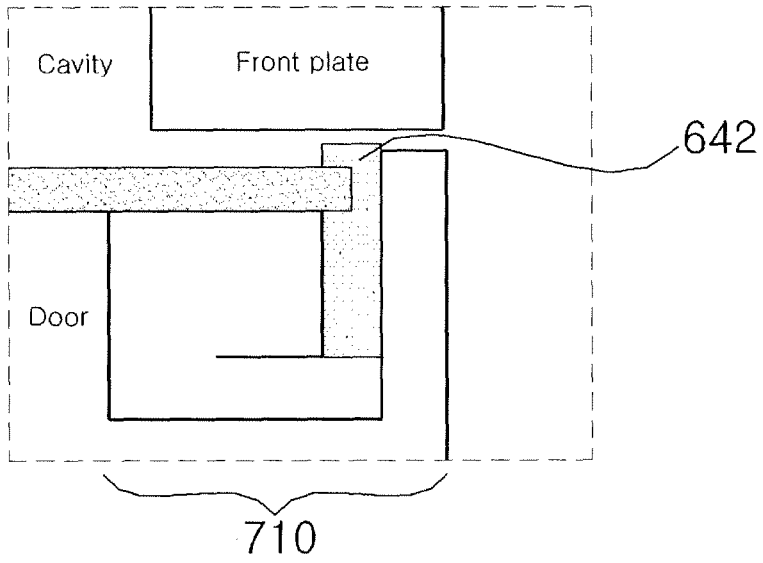

Next, a door choke 710 of FIG. 9 is similar to the door choke 610 of FIG. 8, and thus only parts of the door choke 710 differing from those of the door choke 610 will be described hereinafter. The door choke 710 of FIG. 9 differs from the door choke 610 of FIG. 8 in terms of the shape of a dielectric.

While the dielectric 640 of FIG. 8 is disposed between the first attachment member 620 and the second attachment member 630 and between the glass substrate 650 and the second bent part 634 of the second attachment member 630, a dielectric 642 of FIG. 9 is disposed between the first attachment member 620 and the second attachment member 630 such that both surfaces of the dielectric 642 are respectively attached to the first attachment member 620 and the second attachment member 630. Thereby, the capacitance component C of the door choke 710 of FIG. 9 is higher than the capacitance component C of the door choke 610 of FIG. 8.

Figure 10:
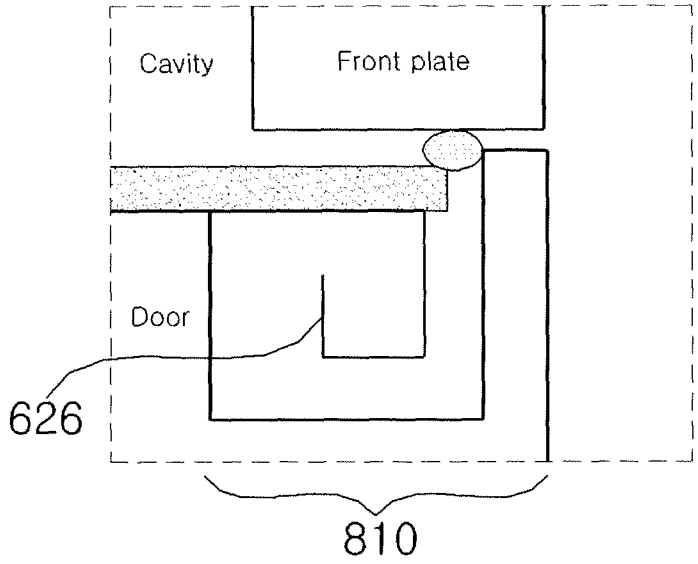

Next, a door choke 810 of FIG. 10 is similar to the door choke 610 of FIG. 8, and thus only parts of the door choke 810 differing from those of the door choke 610 will be described hereinafter. The door choke 810 of FIG. 10 differs from the door choke 610 of FIG. 8 in terms of the first attachment member.

The first attachment member 620 of the door choke 810 of FIG. 10 further includes a third bent part 626 attached to the second bent part 624 and bent so as to surround the space 625. Thereby, the inductance component L of the door choke 810 of FIG. 10 is higher than the inductance component L of the door choke 610 of FIG. 8.

Figure 11:
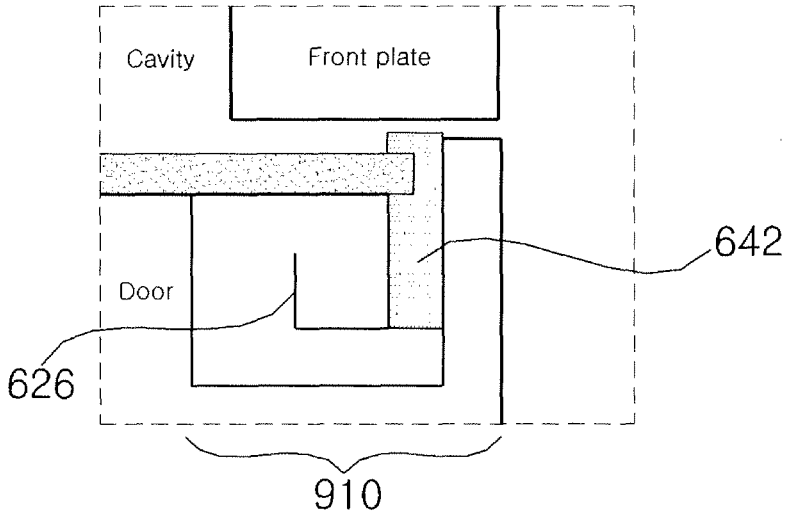

Next, a door choke 910 of FIG. 11 is similar to the door choke 610 of FIG. 8, and thus only parts of the door choke 910 differing from those of the door choke 610 will be described hereinafter. The door choke 910 of FIG. 11 differs from the door choke 610 of FIG. 8 in terms of the dielectric and the first attachment member.

While the dielectric 640 of FIG. 8 is disposed between the first attachment member 620 and the second attachment member 630 and between the glass substrate 650 and the second bent part 634 of the second attachment member 630, a dielectric 642 of FIG. 11 is disposed between the first attachment member 620 and the second attachment member 630 such that both surfaces of the dielectric 642 are respectively attached to the first attachment member 620 and the second attachment member 630. Thereby, the capacitance component C of the door choke 910 of FIG. 11 is higher than the capacitance component C of the door choke 610 of FIG. 8.

Further, the first attachment member 620 of the door choke 910 of FIG. 11 further may include a third bent part 626 attached to the second bent part 624 and bent so as to surround the space 625. Thereby, the inductance component L of the door choke 910 of FIG. 11 is higher than the inductance component L of the door choke 610 of FIG. 8.

Figure 12:
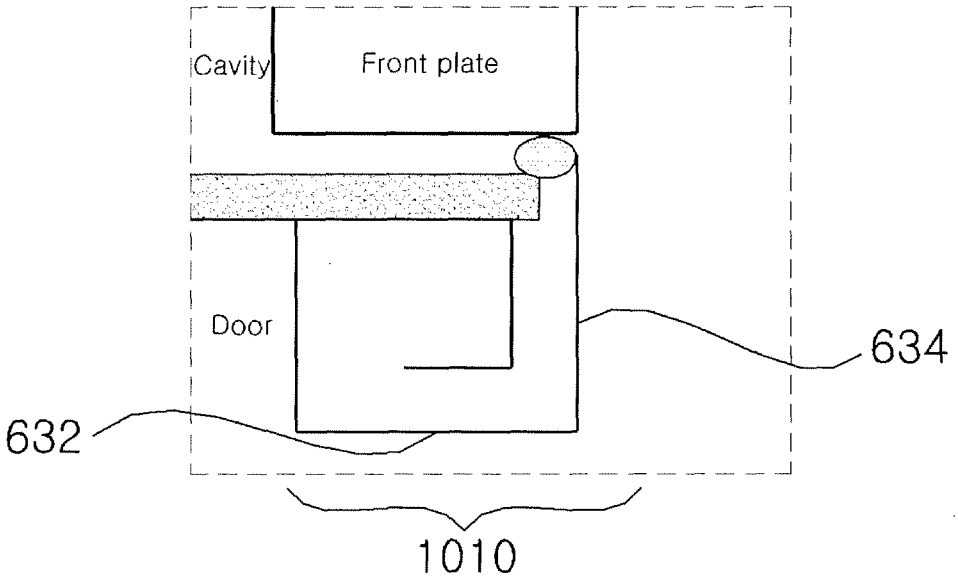

Next, a door choke 1010 of FIG. 12 is similar to the door choke 610 of FIG. 8, and thus only parts of the door choke 1010 differing from those of the door choke 610 will be described hereinafter. The door choke 1010 of FIG. 12 differs from the door choke 610 of FIG. 8 in terms of the second attachment member.

The second attachment member 630 of the door choke 1010 of FIG. 12 only includes the base part 631, the first bent part 632 and the second bent part 634. That is, the second attachment member 630 includes two bent parts 632 and 634. Nonetheless, the door choke 1010 of FIG. 12 includes the first attachment member 620 and the second attachment member 630 bent in opposite directions so as to form the space 625, and thus the above-described effects may be obtained.

Figure 13:
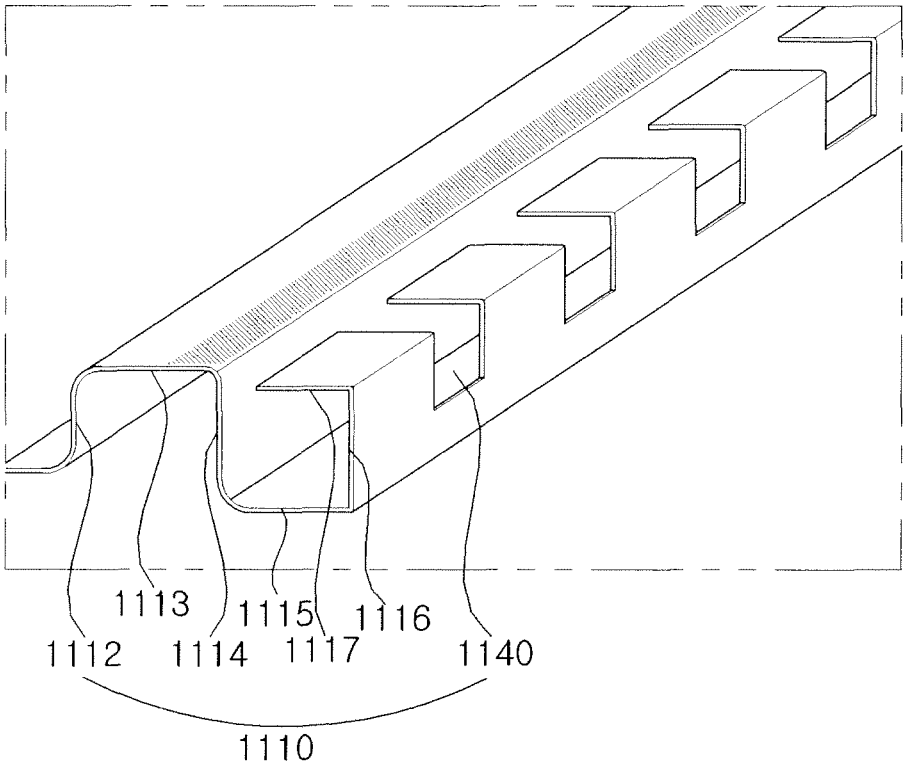
FIGS. 13 and 14 are reference views illustrating the door choke in accordance with the embodiment of the present invention.
Figure 14:
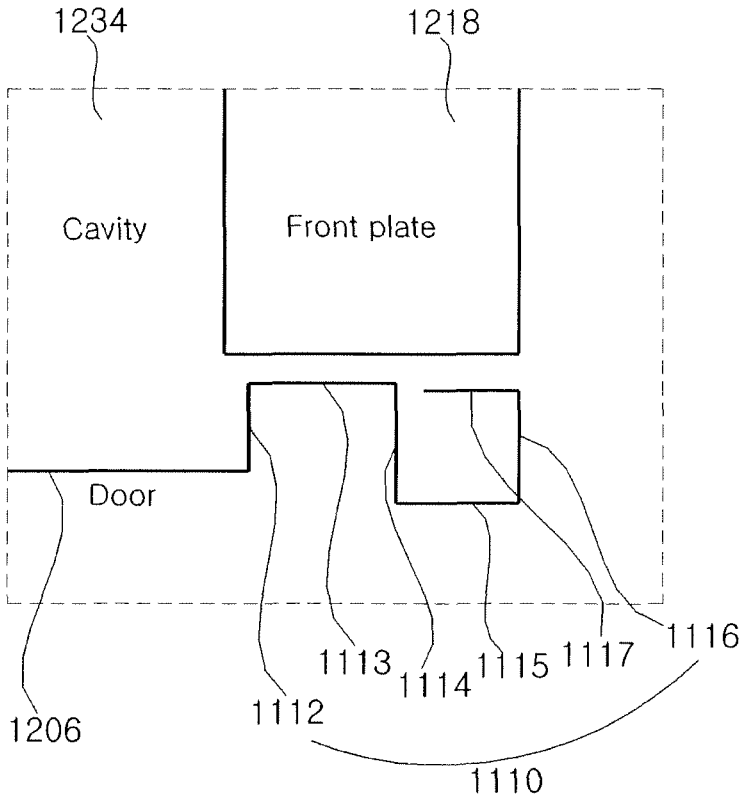

FIGS. 13 and 14 are reference views illustrating the door choke in accordance with the embodiment of the present invention.

FIGS. 13 and 14 illustrate the structure of a conventional door choke 1110. According to such a structure, the door choke 1110 is attached to a door 1206 to open and close a cavity 1234, and includes first bent parts to sixth bent parts 1112, 1113, 1114, 1115, 1116 and 117. Further, slits 1140 may be formed on the door choke 1110. Such a door choke 1110 includes excessively many bent parts for space formation, and thus has a large size. Further, a glass substrate attached to the inner surface of the door 1206 is not extended in the direction of a front plate 1218.

As compared with the door choke 1110 of FIGS. 13 and 14, the door choke in accordance with the embodiment of the present invention is disposed such that each of the first attachment member and the second attachment member has at least two bent parts under the condition that the space is formed between the first attachment member and the second attachment member, and the first attachment member and the second attachment member are bent in opposite directions, thereby improving the inductance component and the capacitance component.

Therefore, a distance between the first attachment member and the second attachment member may be shortened, and thereby, the door choke may have a compact structure.

Figure 15:
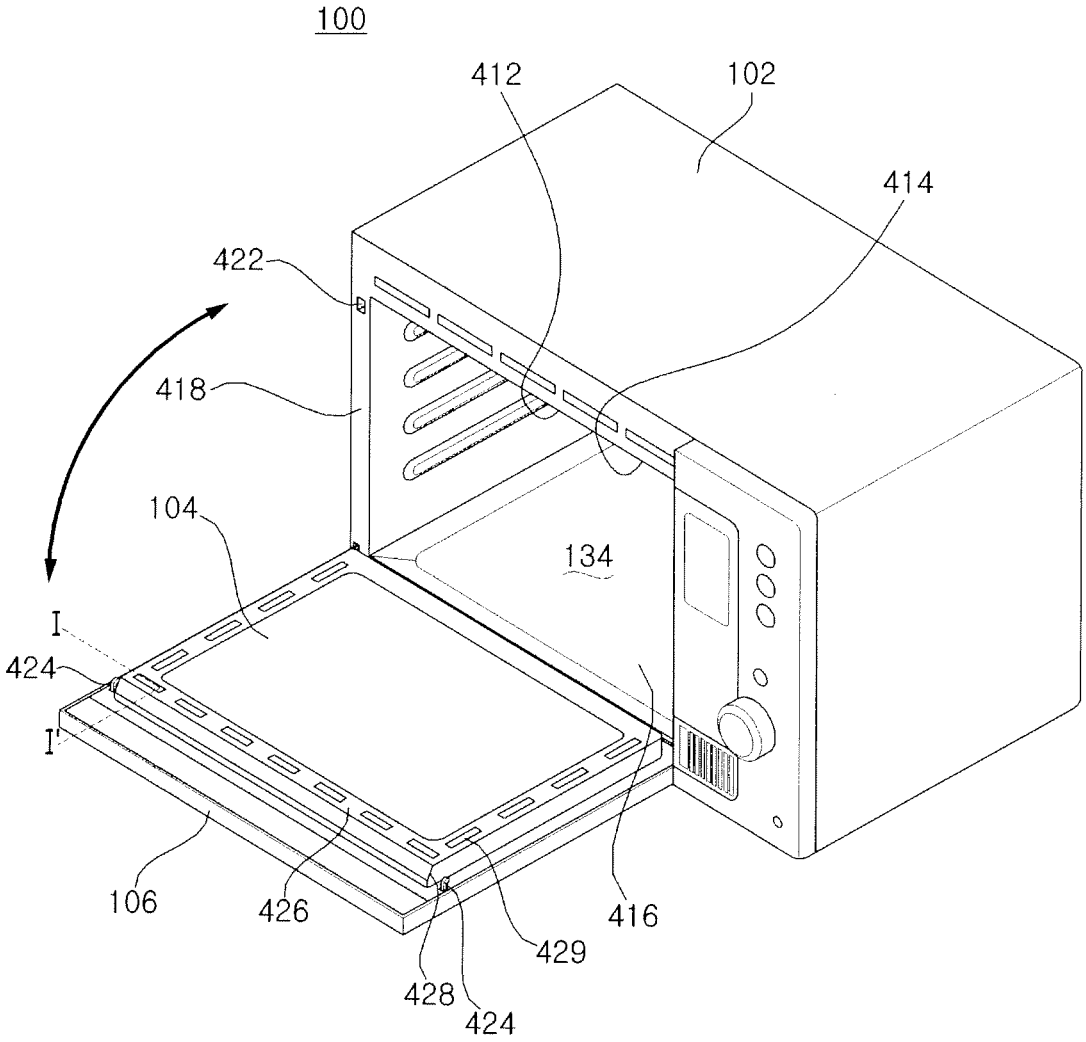
FIG. 15 is a view illustrating another example of opening of the door of the cooking apparatus of FIG. 1.
Figure 16:
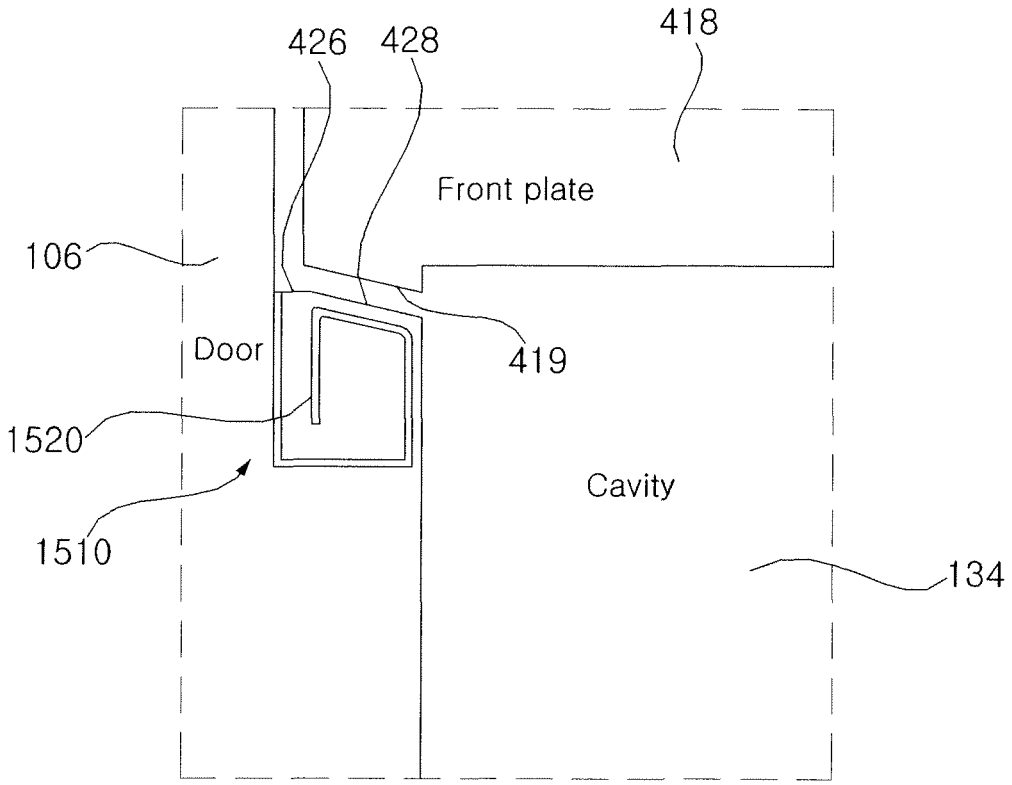
FIG. 16 is a partial perspective view illustrating the door choke taken along the line I-I' of the door of FIG. 15.
Figure 17:
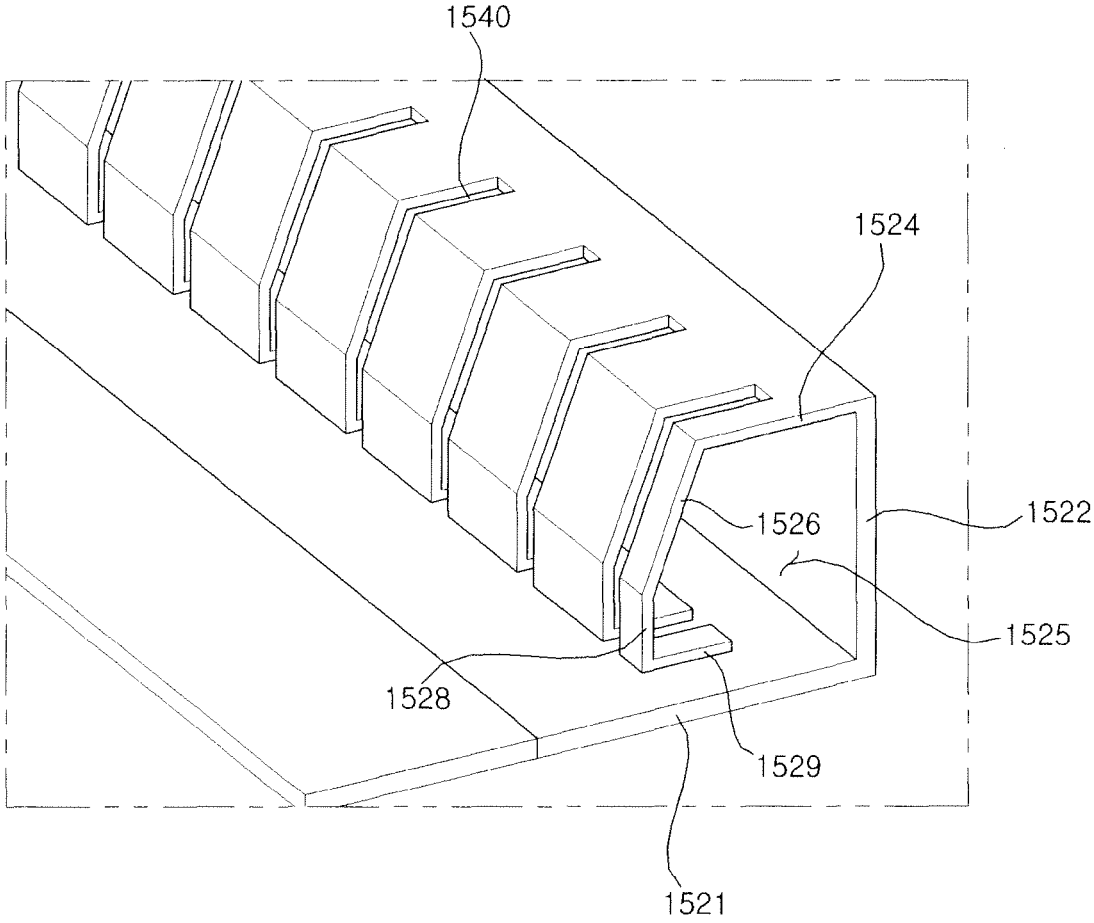
FIG. 17 is a side view of the door choke of FIG. 16.

FIG. 15 is a view illustrating another example of opening of the door of the cooking apparatus of FIG. 1, FIG. 16 is a partial perspective view illustrating the door choke taken along the line I-I' of the door of FIG. 15, and FIG. 17 is a side view of the door choke of FIG. 16. The door of FIG. 15 is similar to the door of FIG. 6, but differs from the door of FIG. 6 in that the choke cover 426 is attached to the door 106 so as to be protruded from the door 106.

The choke cover 426 to cover a door choke 1510 attached to the door 106 so as to be protruded from the door 106 may be provided on the rear surface of the door 106. Such a choke cover 426 may be formed in a shape surrounding a glass substrate of the cooking window 104. Further, a plurality of inlets may be formed at the upper portion or the side portions of the choke cover 426, as shown in FIG. 15.

The door choke 1510 is attached to the door 106 so as to be protruded from the door 106. As shown in FIGS. 15 and 16, if the door 106 is opened and closed in the vertical direction, the front plate 418 may collide with the protruded door choke 1510.

In the embodiment of the present invention, in order to solve the above problem, a part of the door choke 1510 is inclined in the rotating direction of the door 106. In more detail, an adjacent part of the door choke 1510 adjacent to the front plate 418 is formed in an oblique line when the door 106 is closed. An angle of the inclined or oblique structure in the description means an obtuse angle which exceeds 90 degrees and is below 180 degrees. Due to such a structure, collision of the door choke 1510 with the front plate 418 when the door 106 is opened and closed is prevented.

FIGS. 16 and 17 illustrate one example of such a door choke 1510. With reference to FIGS. 16 and 17, the door choke 1510 includes a first attachment member 1520 including at least two bent parts.

The first attachment member 1520 includes a base part 1521 attached to the door 106, a first bent part 1522 attached to the base part 1521 and bent so as to form a space 1525, and a third bent part 1524 attached to the first bent part 1522, bent so as to form the space 1525 and inclined corresponding to the front plate 418. The first attachment member 1520 may further include a fourth bent part 1528 attached to the third bent part 1526 and bent.

The third bent part 1526 is most adjacent to the front plate 418, and may thus be referred to as an adjacent part.

An angle between the second bent part 1524 and the third bent part 1526 is set to an obtuse angle instead of the right angle (90 degrees) in such a manner, thereby preventing collision of the door choke 1510 with the front plate 418 when the door 106 is opened and closed.

Further, a part 428 of the choke cover 426 to cover the door choke 1510 corresponding to the third bent part 1526 may be inclined.

Moreover, the front plate 418 may have a tapered part 419 corresponding to the adjacent part (third bent part) 1526 having the oblique structure formed on the door choke 1510.

In the embodiment of the present invention, the door choke 1510 is disposed such that the first attachment member 1520 includes at least two bent parts.

In general, a shield frequency to shield electromagnetic interference is calculated based on Equation 2 above.

As described above, frequencies of microwaves may be in the range of approximately 900 MHz~2,500 MHz. Particularly, since, if a frequency within a designated range around 915 MHz is used, the frequency is lower than a frequency within a designated range around 2,450 MHz, the door choke is preferably designed such that the inductance component L and the capacitance component C of the door choke increase based on Equation 2 above.

With reference to FIGS. 16 and 17, the inductance component L of the door choke 1510 is determined by the number or the length of the bent parts of the first attachment member 1520. That is, as the number of the bent parts increases and the length of the bent parts increases, the entire inductance component L increases.

Slits 1540 may be formed on the first attachment member 1520 in the bending direction thereof. As the number of the slits 1540 increases, i.e. the interval between the slits 1540 decreases, the entire inductance component L increases.

The capacitance component C is calculated based on Equation 3 above.

That is, as an opposite area A between the bent parts of the first attachment member 1520 increases, the distance between the bent parts of the first attachment member 1520 decreases, and the dielectric constant μ increases, the capacitance component C of the door choke 1510 increases.

As described above, in order to shield the corresponding frequency f, the number or the length of the bent parts of the first attachment member 1520 of the door choke 1510 and the interval between the slits 1540, or the dielectric constant is preferably adjusted.

Preferably, the door choke 1510 is made of a metal to shield electromagnetic interference.

FIGS. 18 to 21 are views illustrating various door chokes in accordance with embodiments of the present invention.

Hereinafter, door chokes further including a second attachment member in addition to the first attachment will be described, differently from the door choke of FIG. 16 or 17.

Particularly, the first attachment member and the second attachment member are bent in opposite directions. Thereby, the door choke 510 may be designed such that the inductance component L and the capacitance component C increase while forming the space in which electromagnetic interference cancellation of microwaves occurs.

Figure 18:
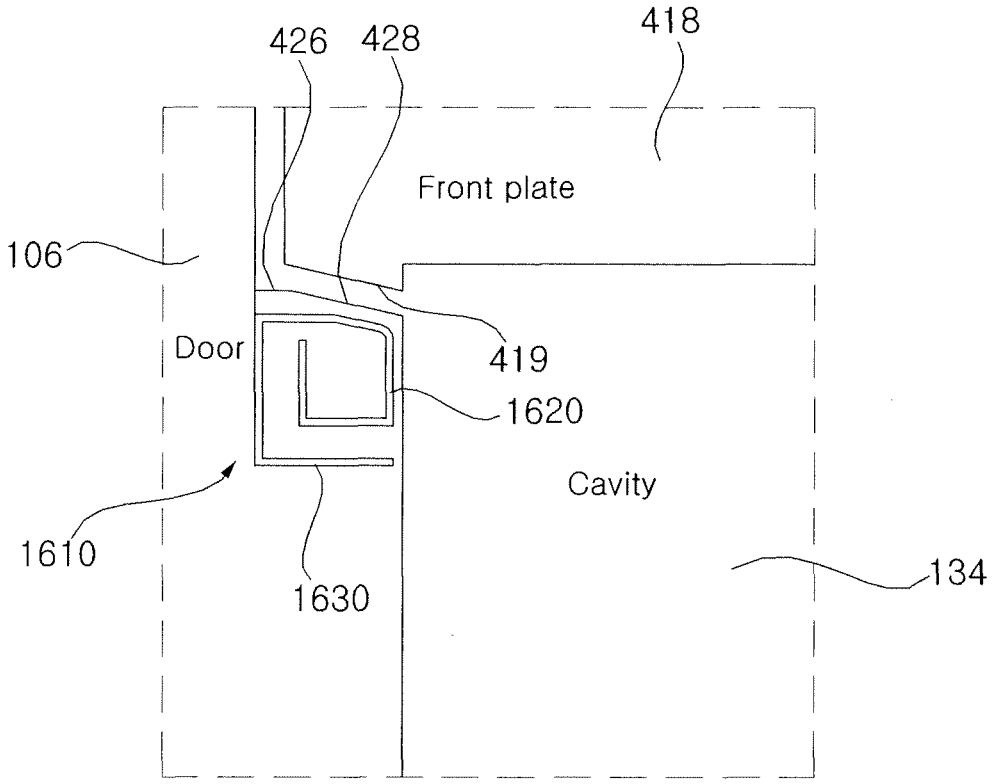
FIGS. 18 to 21 are views illustrating various door chokes in accordance with embodiments of the present invention.
Figure 19:
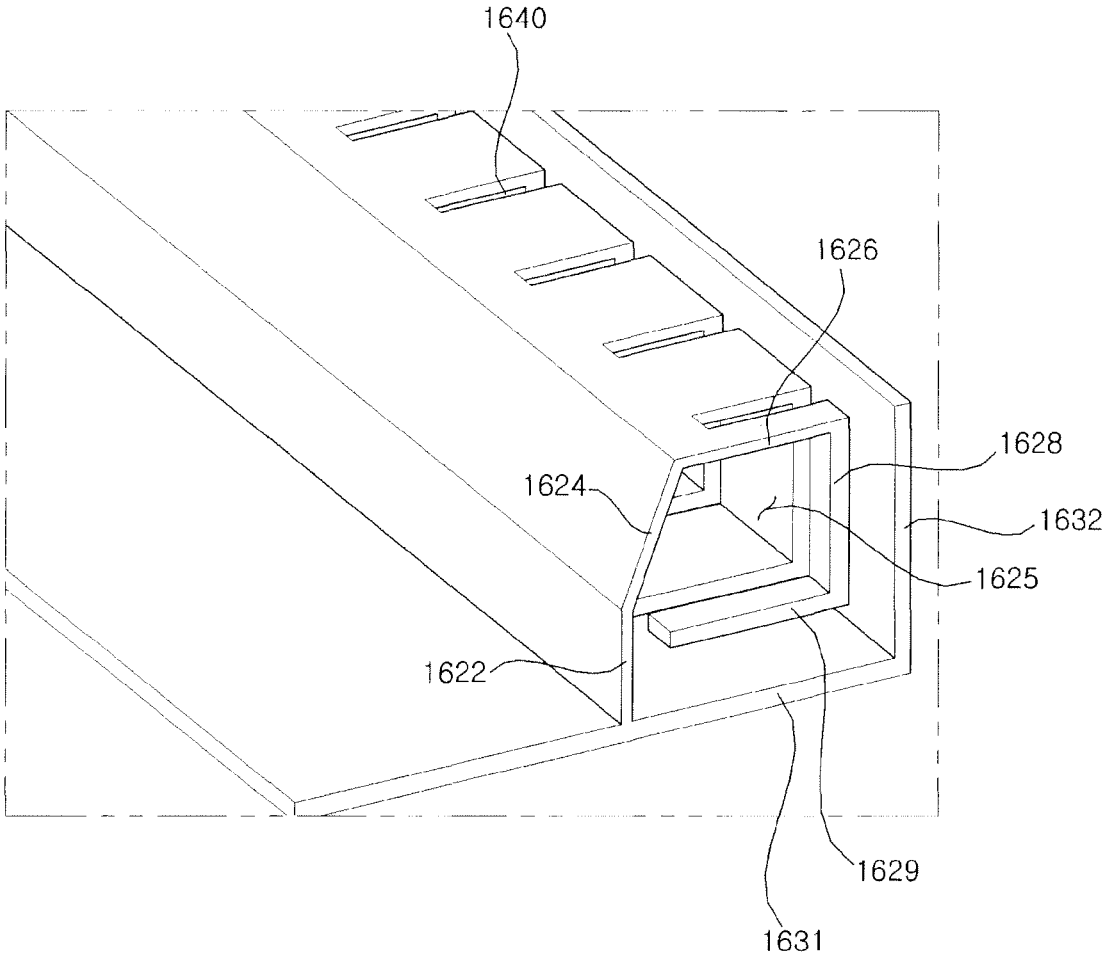

First, a first attachment member 1620 of a door choke 1610 of FIG. 18 or 19 includes a first bent part 1622 attached to the door 106 and bent so as to form a space 1625, and a second bent part 1624 attached to the first bent part 1622, bent so as to form the space 1625, and inclined corresponding to the front plate 418.

The second bent part 1624 is most adjacent to the front plate 418, and may thus be referred to as an adjacent part. An angle between the first bent part 1622 and the second bent part 1624 is set to an obtuse angle instead of the right angle (90 degrees) in such a manner, thereby preventing collision of the door choke 1610 with the front plate 418 when the door 106 is opened and closed. Further, a part 428 of the choke cover 426 to cover the door choke 1610 corresponding to the second bent part 1624 may be inclined. Moreover, the front plate 418 may have a tapered part 419 corresponding to the adjacent part (second bent part) 1624 having the oblique structure formed on the door choke 1610.

The first attachment member 1620 may further include a third bent part 1626 attached to the second bent part 1624 and bent so as to form the space 1625. In addition, the first attachment member 1620 may further include a fourth bent part 1628 attached to the third bent part 1626 and bent, and a fifth bent part 1629 attached to the fourth bent part 1628 and bent.

A second attachment member 1630 includes a base part 1631 attached to the door 106 and extended, and a bent part 1632 attached to the base part 1631 and bent in the opposite direction to the bending direction of the first attachment member 1620.

Further, a dielectric (not shown) may be disposed between the first attachment member 1620 and the second attachment member 1630. Thereby, the capacitance component of the door choke 1610 may increase, as stated in Equation 3 above.

Through the structure of the door choke 1610 of FIGS. 18 and 19, collision generated when the door 106 is opened and closed may be prevented and the door choke 1610 may be designed to have a compact structure.

Figure 20:
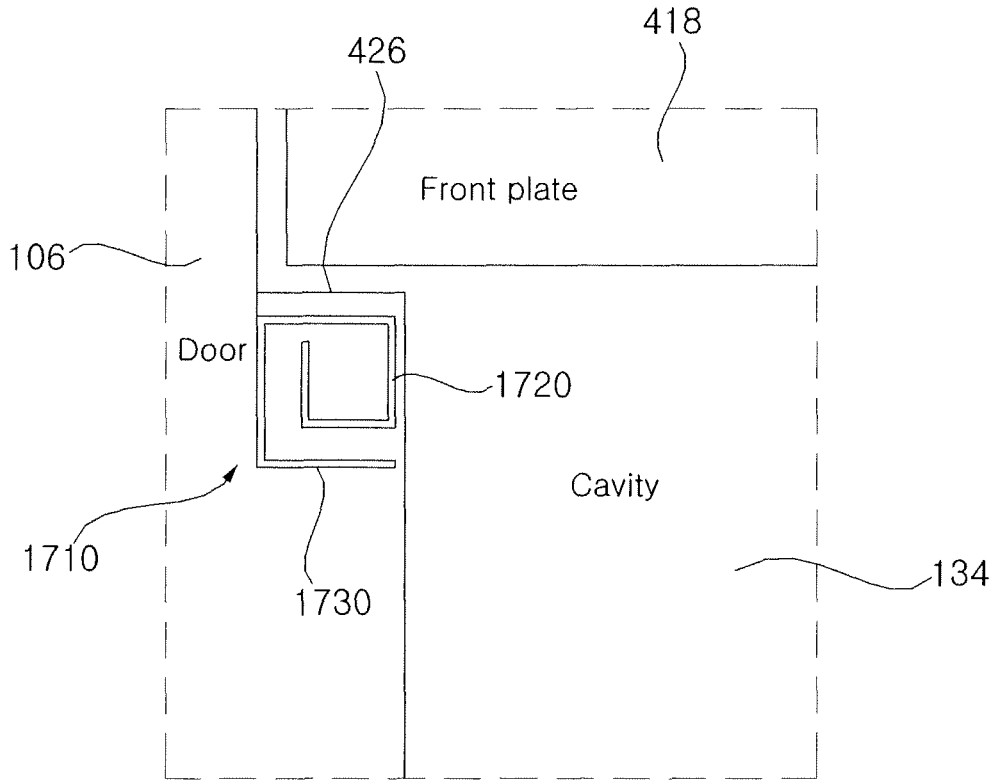
Figure 21:
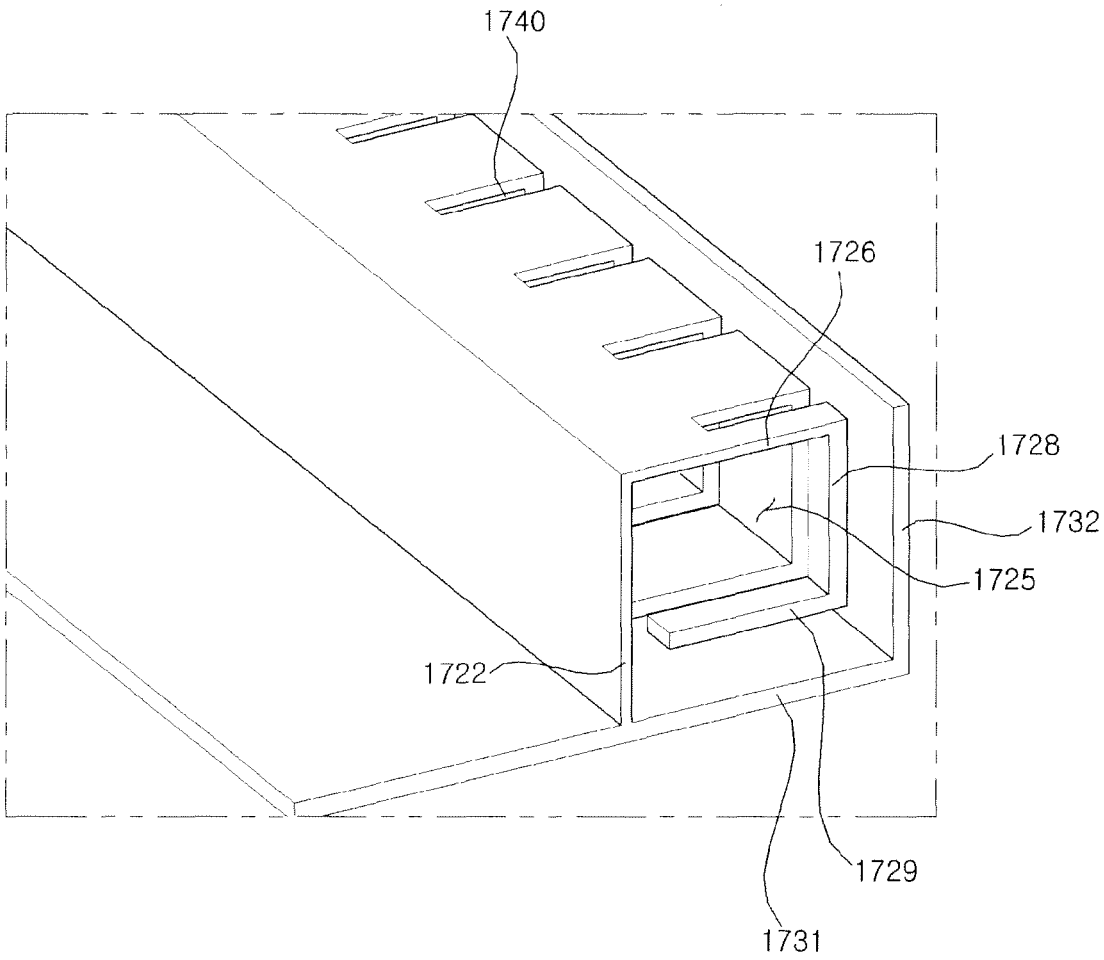

Next, a door choke 1710 of FIG. 20 or 21 differs from the door choke 1610 of FIG. 18 or 19 in that the door choke 1710 does not include an inclined part. However, the door choke 1710 is protruded from the door 106, thus having a structure similar to that of FIG. 18 or 19.

A first attachment member 1720 of the door choke 1710 includes a first bent part 1722 attached to the door 106 and bent so as to form a space 1725, and a second bent part 1726 attached to the first bent part 1722 and bent so as to form the space 1725.

The first attachment member 1720 may further include a third bent part 1728 attached to the second bent part 1726 and bent so as to form the space 1725. In addition, the first attachment member 1720 may further include a fourth bent part 1729 attached to the third bent part 1728 and bent.

A second attachment member 1730 includes a base part 1731 attached to the door 106 and extended, and a bent part 1732 attached to the base part 1731 and bent in the opposite direction to the bending direction of the first attachment member 1720.

Further, a dielectric (not shown) may be disposed between the first attachment member 1720 and the second attachment member 1730. Thereby, the capacitance component of the door choke 1710 may increase, as stated in Equation 3 above.

Through the structure of the door choke 1710 of FIGS. 20 and 21, collision generated when the door 106 is opened and closed may be prevented and the door choke 1710 may be designed to have a compact structure.

The controller 310 may perform the above control operations of the microwave controller 350. The controller 310 may calculate heating efficiencies based on microwave frequencies reflected by the inside of the cavity from among the output microwaves, calculate microwaves, the calculated heating efficiencies of which are more than reference efficiency, and calculate heating times of the calculated microwaves.

Although the embodiment of the present invention describes the cooking apparatus using microwaves, the present invention is not limited thereto and the cooking apparatus using microwaves may be combined with various cooking apparatuses. As one example, the cooking apparatus using microwaves in accordance with the embodiment of the present invention may be combined with an oven-type cooking apparatus using a heater as a heating source. Further, as another example, the cooking apparatus using microwaves in accordance with the embodiment of the present invention may be combined with a cooking apparatus using an induction heater as a heating source. Further, as a further example, the cooking apparatus using microwaves in accordance with the embodiment of the present invention may be combined with a cooking apparatus using a magnetron as a heating source.

The door choke and the cooking apparatus including the same in accordance with the present invention are not limited to configurations and methods of the above-described embodiments, and all or some of the respective embodiments may be selectively combined so as to achieve various modifications.

As apparent from the above description, a door choke of a cooking apparatus in accordance with one embodiment of the present invention is disposed such that each of a first attachment member and a second attachment member has at least two bent parts under the condition that a space is formed between the first attachment member and the second attachment member, and the first attachment member and the second attachment members are bent in opposite directions, thus improving an inductance component and a capacitance component. Thereby, the door choke may have a compact structure and achieve effective electromagnetic interference shielding.

Further, a dielectric may be disposed between the first attachment member and the second attachment member, thereby increasing the capacitance component of the door choke.

Such a dielectric may be disposed so as to be closer to a front plate than the door choke when a door is closed, thereby preventing scratches due to collision between the door choke and the front plate when the door is closed.

Further, the second attachment member may be disposed so as to be close to the front plate, thereby preventing leakage of microwaves to the outside.

A glass substrate disposed on the inner surface of the door may be extended to a region between the first attachment member and the second attachment member, thereby preventing introduction of foreign substances from a cavity to a gap between the first attachment member and the second attachment member.

Further, a door choke of a cooking apparatus in accordance with another embodiment of the present invention is capable of shielding electromagnetic interference and includes an adjacent part having an oblique structure which is adjacent to a plate when the door is closed, thereby preventing collision with the plate when the door is opened and closed. Particularly, if the door choke is protruded from the door, collision of the door choke with the plate may be greatly prevented.

Further, bent parts are provided on the door choke, and thus the size of the door choke may be adjusted.

Moreover, the cooking apparatus outputs microwaves of frequencies in a designated range and then selectively outputs the microwaves according to calculated heating efficiencies, thereby achieving uniform heating of an object within a cavity.

Effects of the present invention are not limited to the above-stated effects, and those skilled in the art will understand other effects, which are not stated above, from the accompanying claims.

Although the embodiments of the present invention have been disclosed for illustrative purposes, those skilled in the art will appreciate that various modifications and applications are possible, without departing from the scope and spirit of the invention as disclosed in the accompanying claims. For example, the respective elements described in detail in the embodiments may be modified. Further, it will be understood that differences relating to such modifications and applications are within the scope of the invention defined in the accompanying claims.

What is claimed is:

1. A cooking apparatus comprising:

a plate forming a cavity;

a door to open and close the cavity; and a door choke including a first attachment member attached to the door and including at least two bent parts and a second attachment member attached to the door and including at least two bent parts so as to be separated from the first attachment member, wherein the first attachment member comprises:

a base part attached to the door and extending across the door;

a first bent part extending from the base part and bent; and a second bent part extending from the first bent part and bent so as to form a space, wherein the second attachment member comprises:

a base part attached to the door and extending across the door;

a first bent part extending from the base part of the second attachment member and bent so as to form the space; and a second bent part extending from the first bent part of the second attachment member and bent so as to surround the space, wherein the at least two bent parts of the first attachment member and the at least two bent parts of the second attachment member forms the same space, and wherein a bending direction from the base part to the second bent part of the first attachment member is a clockwise direction and a bending direction from the base part to the second bent part of the second attachment member is a counterclockwise direction.

2. The cooking apparatus according to claim 1, further comprising a dielectric in between the first attachment member and the second attachment member.

3. The cooking apparatus according to claim 2, wherein the dielectric is closer to the plate than the door choke when the door is closed.

4. The cooking apparatus according to claim 1, wherein the first attachment member further comprises a plurality of slits in the bending direction of the first attachment member.

5. The cooking apparatus according to claim 1, wherein a distance between the second attachment member and the plate is shorter than a distance between the first attachment member and the plate.

6. The cooking apparatus according to claim 1, further comprising a glass substrate attached to an inner surface of the door.

7. The cooking apparatus according to claim 6, wherein the glass substrate is extended to a region between the first attachment member and the second attachment member.

8. The cooking apparatus according to claim 1, wherein the second attachment member further comprises:

a third bent part extending from the second bent part of the second attachment member and bent so as to be parallel with the plate; and a fourth bent part extending from the third bent part and bent so as to be parallel with the second bent part.

9. The cooking apparatus according to claim 1, wherein an adjacent part of the door choke, which is adjacent to the plate when the door is closed, has an oblique structure.

10. The cooking apparatus according to claim 9, wherein the plate includes a tapered part corresponding to the adjacent part of the door choke having the oblique structure.

11. The cooking apparatus according to claim 9, wherein the oblique structure of the adjacent part is inclined in a rotating direction of the door.

12. The cooking apparatus according to claim 9, wherein the first attachment member further comprises:

a third bent part extending from the second bent part, bent so as to form the space, and angled with respect to the plate.

13. The cooking apparatus according to claim 9, wherein the door choke is attached to the door so as to be protruded from the door.

14. The cooking apparatus according to claim 9, further comprising a microwave generator to generate microwaves, and a controller to calculate heating efficiencies of the microwaves according to frequencies supplied to the inside of the cavity and frequencies reflected by the inside of the cavity, and to generate microwaves of designated frequencies based on the calculated heating efficiencies.

15. A door choke comprising:

a first attachment member attached to a door and including at least two bent parts; and a second attachment member attached to the door and including at least two bent parts so as to be separated from the first attachment member, wherein the first attachment member comprises:

a base part attached to the door and extending across the door;

a first bent part attached to the base part and bent; and a second bent part extending from the first bent part and bent so as to form a space, wherein the second attachment member includes:

a base part attached to the door and extended across the door;

a first bent part extending from the base part of the second attachment member and bent so as to surround the space; and a fourth bent part extending from the second bent part and bent so as to surround the space, wherein the at least two bent parts of the first attachment member and the at least two bent parts of the second attachment member form the same space, and wherein a bending direction from the base part to the second bent part of the first attachment member is a clockwise direction and a bending direction from the base part to the second bent part of the second attachment member is a counterclockwise direction.

16. The door choke according to claim 15, further comprising a dielectric in between the first attachment member and the second attachment member.

17. The door choke according to claim 15, wherein the first attachment member includes a plurality of slits formed in the bending direction of the first attachment member.

* * * * *